US007395202B2

(12) United States Patent
Hetherington et al.

(10) Patent No.: US 7,395,202 B2
(45) Date of Patent: Jul. 1, 2008

(54) METHOD AND APPARATUS TO FACILITATE VOCODER ERASURE PROCESSING

(75) Inventors: Mark D. Hetherington, Crystal Lake, IL (US); Michael J. Kirk, Mount Prospect, IL (US); Lee M. Proctor, Cary, IL (US); Zhongwei Zhuang, Vernon Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 401 days.

(21) Appl. No.: 11/148,902

(22) Filed: Jun. 9, 2005

(65) Prior Publication Data

US 2006/0282259 A1 Dec. 14, 2006

(51) Int. Cl.
*G10L 19/00* (2006.01)

(52) U.S. Cl. ..... 704/221; 704/265; 704/500; 714/758

(58) Field of Classification Search ..... 704/221, 704/265, 500; 714/758
See application file for complete search history.

(56) References Cited

U.S. PATENT DOCUMENTS

| | | | | | |
|---|---|---|---|---|---|
| 5,600,754 | A * | 2/1997 | Gardner et al. | ..... | 704/221 |
| 6,055,497 | A * | 4/2000 | Hallkvist et al. | ..... | 704/228 |
| 6,148,422 | A * | 11/2000 | Strawczynski et al. | ..... | 714/704 |
| 2003/0074197 | A1 * | 4/2003 | Chen | ..... | 704/262 |
| 2003/0078769 | A1 * | 4/2003 | Chen | ..... | 704/211 |
| 2006/0173687 | A1 * | 8/2006 | Spindola | ..... | 704/265 |

* cited by examiner

*Primary Examiner*—Daniel Abebe

(57) ABSTRACT

Upon receiving (101) a vocoded voice frame and detecting (102) that the received vocoded voice frame comprises an erased frame, one automatically replaces (103) the erased frame with a valid frame having at least one error condition. In a preferred approach this error condition is one that is known to cause a receiving target platform to invoke a corresponding erasure process with respect to the valid frame when received.

19 Claims, 1 Drawing Sheet

METHOD AND APPARATUS TO FACILITATE VOCODER ERASURE PROCESSING

TECHNICAL FIELD

This invention relates generally to communication systems and more particularly to the use of vocoded speech.

BACKGROUND

Communication systems of various kinds are known in the art. Many such systems support the conveyance of speech. In its natural or fully digitized form speech can consume a considerable amount of bandwidth. A strong needs exists, however, to limit bandwidth usage in many communication systems to thereby permit supporting a large user base. Vocoding techniques are often employed to meet these concurrent but sometimes opposing needs.

Various forms of vocoding are known. In general, digitized speech is analyzed and then characterized by representative parameters. These parameters are usable to effect reconstruction of the original speech content and typically require considerably less bandwidth to effect their conveyance.

It is also known that vocoding information can be damaged during transit. Wireless communication systems are particularly susceptible to such phenomena. Because speech transmissions are often real time sessions there will usually not be sufficient time to permit a damaged parcel of vocoding information to be replaced. Accordingly, many modern vocoding systems will recognize when a given frame of vocoded voice has been damaged or otherwise sufficiently corrupted during transit (to a point where the vocoder information cannot be reliably decoded) and can categorize such a frame as being "erased." Upon recognizing that a given vocoded voice frame is erased, any of a variety of techniques (such as interpolation, insertion of noise, and so forth) can be employed to at least attempt to minimize the impact of the lost information.

Unfortunately, not all systems can reliably ascertain the existence of an erased frame of vocoder information. More particularly, not all mobile stations may be configured to reliably detect when a given received vocoder frame is, in fact, erased. Problems such as this can arise, for example, as system protocols advance with time and legacy user equipment fails to remain completely current with all operating protocols.

BRIEF DESCRIPTION OF THE DRAWINGS

The above needs are at least partially met through provision of the method and apparatus to facilitate vocoder erasure processing described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the arts will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, upon receiving a transmitted message that comprises at least one vocoded voice frame and detecting that this vocoded voice frame comprises an erased frame, one automatically replaces that erased frame with a valid frame having at least one error condition. In a preferred embodiment this error condition comprises one that is known to invoke vocoder erasure processing in a receiving target platform. That valid frame is then transmitted to the receiving target platform.

In a preferred approach these steps are realized via one or more system infrastructure elements. This, in turn, permits a potentially outdated target platform to nevertheless respond appropriately to erased vocoded voice frame events.

Any of a variety of such error conditions can be utilized so long as the error condition, upon being noted by the receiving target platform, is one that will stimulate the desired behavior; i.e., treatment of that particular vocoded voice frame as an erased frame through use of a native vocoder erasure processing capability. Accordingly these teachings can be readily implemented within an existing system without requiring reprogramming of any subscriber units. It will further be seen and appreciated that these teachings do not interfere with, and are otherwise highly compatible with, power control techniques and strategies as may be based upon an assessment of received vocoded voice frames.

Figure 1:
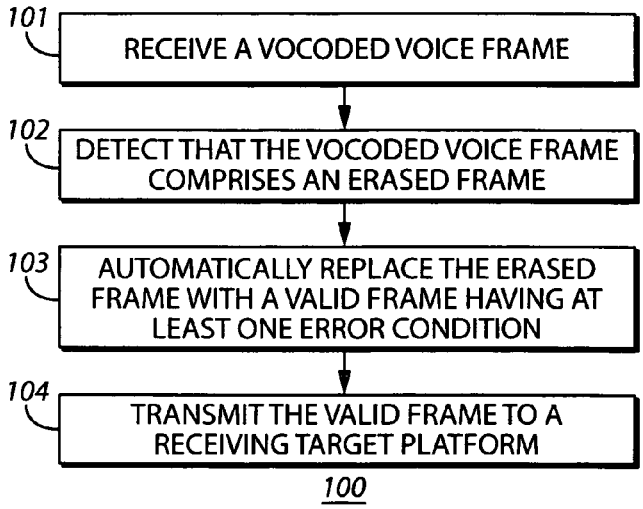
FIG. 1 comprises a flow diagram as configured in accordance with various embodiments of the invention.

These and other benefits may become clearer upon making a thorough review and study of the following detailed description. Referring now to the drawings, and in particular to FIG. 1, an exemplary process 100 may begin with reception 101 of at least one vocoded voice frame. As will be shown below in more detail, this vocoded voice frame may be sourced, for example, by a source mobile station (such as a cellular phone or other two-way wireless device) and conveyed as a wireless message. This may comprise receiving a message that comprises a transmission of a plurality of vocoded voice frames as a group or a transmission of one isolated vocoded voice frame. These teachings are also applicable in settings where the contents of a single vocoded voice frame are parsed and distributed over a plurality of independent transmission events.

Following reception 101, this process 100 then detects 102 when that vocoded voice frame comprises an erased frame (where, again, the technical expression "erased" shall be understood to refer, in this context, to a data frame that has been sufficiently corrupted during transit to render its useful decoding effectively impaired). This step can include, when reception comprises receiving a plurality of vocoded voice frames, detecting which, if any, of the plurality of vocoded voice frames are erased such that this step can comprise, for example, detecting that at least one, but less than all of the plurality of vocoded voice frames comprises an erased frame. Other possibilities are of course possible.

Upon detecting an erased vocoded voice frame, this process 100 then provides for automatic replacement 103 of the erased frame with a valid frame having at least one error condition, wherein the error condition is known to invoke vocoder erasure processing in a receiving target platform. In other words, the erased frame is replaced with a valid frame that nevertheless contains at least one intentional error condition that will prompt, upon reception, the desired erasure behavior on the part of the receiving platform. When receiving and detecting a plurality of erased vocoded voice frames, this step can comprise, of course, automatically replacing each such detected erased frame with a corresponding valid frame having the indicated error condition.

So configured, a receiving platform that might otherwise be unable to recognize the erased vocoded voice frame as, in fact, an erased frame will nevertheless be able to properly process that frame through use of its native erased frame processing capability. This occurs because the receiving platform, though not capable of recognizing (for whatever reason) that the original erased vocoded voice frame is an erased frame, the receiving platform is, essentially by definition, able to recognize a particular error condition which will, in turn and upon being recognized, automatically occasion a response that is identical to what would have occurred had the receiving platform been able to recognize the erased frame as such.

In a preferred embodiment this valid frame comprises a non-NULL traffic channel frame. This, at least in part, aids in avoiding power control issues. By using instead a valid frame that comprises a vocoded voice frame, usual and ordinary power control will continue to prevail. This will typically comprise a desired and beneficial result.

The precise nature of the error condition will of course vary as the application setting varies. As already stipulated, the error condition must be one that the receiving platform will recognize and respond to with an erasure processing response. For some application settings, the error condition can comprise, for example, illegal line spectral pair encoding. For example, the illegal line spectral pair encoding can comprise, in at least some application settings (such as but not limited to application settings that employ Enhanced Variable Rate Code $8^{th}$ rate frame specifications), the presence of at least one line spectral pair value that violates a value-ascendancy requirement.

Consider, as an illustrative example, the following ten line spectral pair values for an Enhanced Variable Rate Codec $8^{th}$ rate frame:

0×F: 0.061378211, 0.098602772, 0.147933320, 0.192831900, 0.231565090

0×6: 0.213775950, 0.331404180, 0.340676870, 0.382220770, 0.409390210

In this illustrative example, there are ten line spectral pairs that are vector quantized with two indices (0×F and 0×6) each representing a vector of five line spectral pairs. In this example, the last line spectral pair in the first vector (having a value of 0.231565090) has an intentionally higher value than the first line spectral pair in the second vector (which has a value of 0.213775950). This violates a value-ascendancy requirement which stipulates that each succeeding value cannot be less than a preceding value. This violation, in turn, when detected by a properly programmed receiving platform, will result in erasure processing of the frame that contains this invalid information.

As another example of a potentially useful error condition, the error condition can comprise configuring the valid frame as a valid eighth rate frame, but wherein this valid eighth rate frame is to be transmitted immediately following transmission of a full rate frame. At least some systems require that an encoder not transmit an eighth rate frame immediately following a full rate frame but must instead follow at least one intervening half rate frame. When such an event occurs in such a system, the receiving platform is again typically programmed to effect the erasure of the eighth rate frame through use of its native vocoder erasure processing.

This process 100 then essentially concludes with transmission 104 of the valid frame to the intended receiving target platform (i.e., the target platform that is expected to respond to the intentionally caused error condition with corresponding vocoder erasure processing). So configured, it should be apparent to those skilled in the art that a mobile platform which is otherwise not capable of identifying a specific erasure event (where, for example, the mobile platform is not programmed to recognize a particular condition or state of the vocoded voice frame that renders that frame unsuitable to decode) is nevertheless able to successfully utilize its erasure processing capability with respect to that event.

Figure 2:
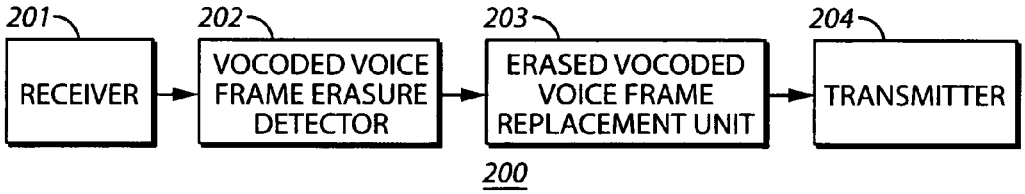
FIG. 2 comprises a block diagram as configured in accordance with various embodiments of the invention.

Those skilled in the art will appreciate that the above-described processes are readily enabled using any of a wide variety of available and/or readily configured platforms, including partially or wholly programmable platforms as are known in the art or dedicated purpose platforms as may be desired for some applications. Referring now to FIG. 2, an illustrative approach to such a platform will now be provided.

An illustrative apparatus 200 to effect these teachings can be comprised generally of a receiver 201, a vocoded voice frame erasure detector 202, an erased vocoded voice frame replacement unit 203, and a transmitter 204. The receiver 201 serves, at least in part, to receive one or more transmissions from, for example, a source mobile station (not shown). This receiver 201 may comprise a wireless and/or a wired receiver depending upon the needs and architecture of the corresponding system. In a preferred approach the received transmissions comprise, at least in part, vocoded voice frames as described above. Receivers in general comprise a well understood area of endeavor. Furthermore, these teachings are not particularly sensitive with respect to use or selection of any one particular style or manner of receiver. Additional elaboration will therefore not be provided here for the sake of brevity.

The received message output of the receiver 201 operably couples to the input of the vocoded voice frame erasure detector 202. The latter serves to assess the received vocoded voice frames and to detect when any such vocoded voice frame comprises an erased frame. The particular and specific criteria by which erasure is defined will of course vary from system to system and protocol to protocol. These teachings are generally applicable for use with all presently known erasure determination criteria and will likely work similarly well with other erasure determination criteria as are developed hereafter. Those skilled in the art will appreciate that when this apparatus 200 comprises an infrastructure element the apparatus 200 may be upgraded relatively easily with new erasure determination criteria as compared to the task of upgrading a deployed fleet of mobile user elements.

The detected erased vocoded voice frame output of the vocoded voice frame erasure detector 202 operably couples to the erased vocoded voice frame replacement unit 203. The latter unit 203 is responsive to detection of an erased frame and reacts through intentional provision of a substitute valid frame having at least one error condition (which, as described above, will have the known result of invoking a vocoder erasure process in a receiving target platform). As alluded to above, this occurs, in a preferred approach, with one-for-one correspondence such that each detected erased frame becomes replaced with a corresponding substitute valid frame that bears the error condition (or conditions).

The output of the erased vocoded voice frame replacement unit 203 then operably couples to an input of the transmitter 204 which serves to forward the substitute valid frame to the target recipient. In a preferred approach, of course, this also comprises forwarding all non-erased vocoded voice frames as well which pass through the apparatus 200 without triggering the replacement process described above. As with the receiver 201, the transmitter 204 may comprise a wired and/or a wireless transmitter, with such platforms all being well understood in the art and requiring no further explanation here.

Those skilled in the art will appreciate that the above-described apparatus 200 may comprise a dedicated purpose platform physically architected as shown, or may comprise a partially or fully programmable platform where the depiction provided in FIG. 2 serves more as a logical view of the supported functionality. It would also be possible to realize these capabilities via an integrated platform or via a distributed architecture. Such architectural variations will be well understood by those skilled in the art and require no further elaboration here.

Figure 3:
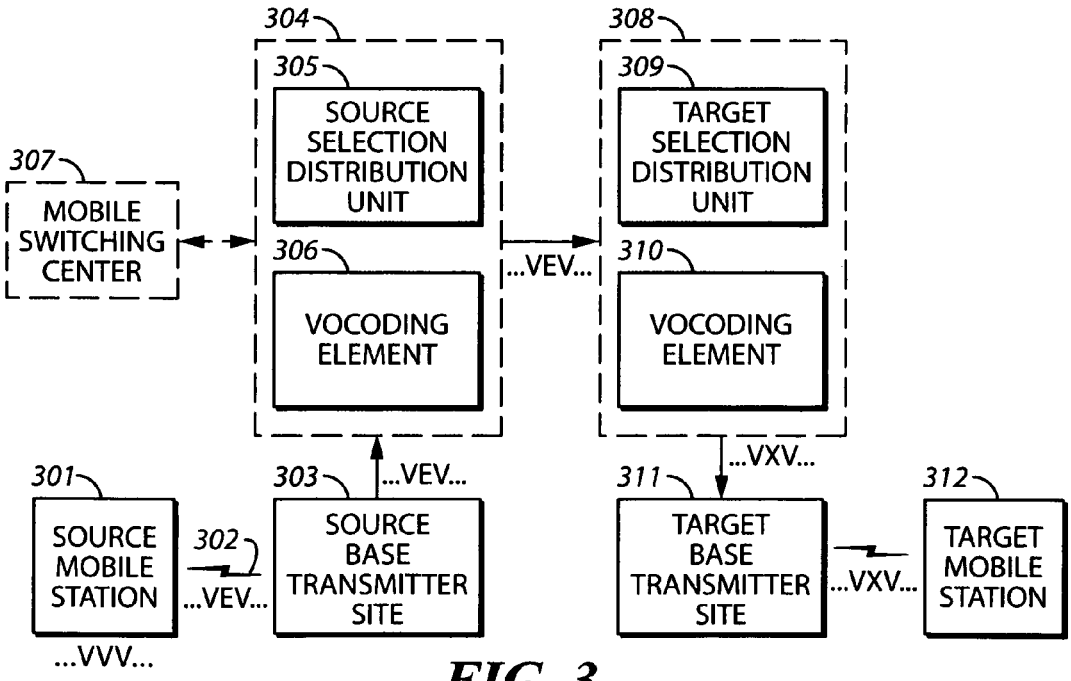
FIG. 3 comprises a block diagram as configured in accordance with various embodiments of the invention.

Referring now to FIG. 3, some specific illustrative examples will now be provided.

In this depiction, a source mobile station 301 (such as, but not limited to a cellular telephone) develops vocoded voice frames (each represented here by the letter "V") to be transmitted. In this example, during transmission, one of the vocoded voice frames becomes erased (represented here by the letter "E") due to perturbations with respect to the wireless transmission path 302. A source base transmitter site 303 receives this transmission and forwards the receiving information, including both the properly received vocoded voice frames as well as the erased vocoded voice frame ("E") to a so-called source Traffic Channel Channel Element (TCH CE) 304 as is known in the art.

In this illustrative embodiment the source TCH CE 304 comprises a source Selection Distribution Unit (SDU) 305 and a vocoding element 306. The former serves, at least in part, to route or otherwise forward the incoming communication and the latter serves, on a selective basis, to transcode the incoming vocoded information into, for example, an alternative representation (such as a Pulse Coded Modulation (PCM) representation as when the TCH CE 304 forwards the incoming communication via a Mobile Switching Center (MSC) 307 to a landline target recipient). In this example the communication from the source mobile station 301 is intended for another wireless element (i.e., a target mobile station 312). Accordingly, the incoming vocoded content is passed without change, decoding, or transcoding to a target TCH CE 308.

The target TCH CE 308 is also comprised, in this illustrative embodiment, of a target Selection Distribution Unit 309 and a vocoding element 310. (Those skilled in the art will recognize that when these TCH CE elements negotiate forwarding of the vocoded content sans alteration via the vocoding elements 306 and 310 the process is often referred to as a tandem-free transmission whereas when these TCH CE elements negotiate a similar result via the selection distribution units 305 and 309 the process is often referred to as a transcoder-free operation.) In this illustrative embodiment, it is the vocoding element 310 of the target TCH CE 308 that effects the teachings set forth above. In particular, it is this vocoding element 310 that detects erased vocoded voice frames and replaces such erased frames with valid frames having the selected error condition(s).

The target TCH CE 308 then forwards the replacement vocoder voice frame (represented here by the letter "X") to a target base transmitter site 311 which then transmits that content to the intended target mobile station 312. The latter will note the error condition as pertains to the replacement vocoder voice frame as per its programming and will effect its erasure processing in lieu of further processing with respect to that replacement frame. As an end result, the target mobile station is therefore seen to properly effect an erasure process with respect to an erased frame that it would not otherwise, in this example, have been able to identify as in fact comprising an erased frame.

Those skilled in the art will further note and appreciate that the replacement frame comprises an actual physically transmitted frame (as contrasted with, for example, a discontinuous transmission (DTX) operation). Consequently, power control properties and operation are not impacted by these teachings. This contrasts sharply with discontinuous transmission approaches which could be employed to force the reception of an erasure frame at a target mobile station, as the latter approach is also known to artificially increase the frame error rate observed by the target mobile station which can cause the target mobile station to artificially increase its power.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A method comprising:

receiving a transmitted message that comprises at least one vocoded voice frame;

detecting that the at least one vocoded voice frame comprises an erased frame;

automatically replacing the erased frame with a valid frame comprising a plurality of encoded speech parameters wherein at least one of the plurality of encoded speech parameters is known to invoke vocoder erasure processing in a receiving target platform;

transmitting the valid frame to the receiving target platform.

2. The method of claim 1 wherein the transmitted message comprises a plurality of vocoded voice frames.

3. The method of claim 2 wherein detecting further comprises detecting that at least one, but less than all of the plurality of vocoded voice frames comprises an erased frame.

4. The method of claim 3 wherein automatically replacing further comprises automatically replacing only the at least one vocoded voice frame that comprises an erased frame, but not any of the plurality of vocoded voice frames that do not comprise an erased frame, with the valid frame having the plurality of encoded speech parameters.

5. The method of claim 1 wherein the valid frame comprises a non-NULL traffic channel frame.

6. The method of claim 1 wherein the at least one of the plurality of encoded speech parameters comprises illegal line spectral pair encoding.

7. The method of claim 6 wherein the illegal line spectral pair encoding comprises at least one line spectral pair value that violates a value-ascendancy requirement.

8. The method of claim 1 wherein the at least one of the plurality of encoded speech parameters comprises configuring the valid frame as a valid eighth rate frame, wherein the valid eighth rate frame is to be transmitted immediately following transmission of a full rate frame.

9. An apparatus comprising:

a receiver having a received message output;

a vocoded voice frame erasure detector having an input operably coupled to the received message output and having a detected erased vocoded voice frame output;

an erased vocoded voice frame replacement unit that is responsive to the detected erased vocoded voice frame output and having an output that provides a substitute valid frame comprising a plurality of encoded speech parameters wherein at least one of the plurality of encoded speech parameters is known to invoke a vocoder erasure process in a receiving target platform;

a transmitter having an input operably coupled to the output of the erased vocoded voice frame replacement unit.

10. The apparatus of claim 9 wherein the substitute valid frame comprises a non-NULL traffic channel frame.

11. The apparatus of claim 9 wherein the at least one of the plurality of encoded speech parameters comprises illegal line spectral pair encoding.

12. The apparatus of claim 11 wherein the illegal line spectral pair encoding comprises at least one line spectral pair value that violates a value-ascendancy requirement.

13. The apparatus of claim 9 wherein the at least one of the plurality of encoded speech parameters comprises configuring the substitute valid frame as a valid eighth rate frame, wherein the valid eighth rate frame is to be transmitted immediately following transmission of a full rate frame.

14. The apparatus of claim 9 wherein the erased vocoded voice frame replacement unit comprises means for automatically replacing a detected erased vocoded voice frame with a valid frame comprising a plurality of encoded speech parameters wherein at least one of the plurality of encoded speech parameters is known to invoke vocoder erasure processing in a receiving target platform.

15. An apparatus comprising:

means for receiving a transmitted message that comprises at least one vocoded voice frame;

means operably coupled to the means for receiving for detecting that the at least one vocoded voice frame comprises an erased frame;

means operably coupled to the means for receiving for automatically replacing the erased frame with a valid frame comprising a plurality of encoded speech parameters wherein at least one of the plurality of encoded speech parameters is known to invoke vocoder erasure processing in a receiving target platform;

mean operably coupled to the means for automatically replacing for transmitting the valid frame to the receiving target platform.

16. The apparatus of claim 15 wherein the valid frame comprises a non-NULL traffic channel frame.

17. The apparatus of claim 15 wherein the at least one of the plurality of encoded speech parameters comprises illegal line spectral pair encoding.

18. The apparatus of claim 17 wherein the illegal line spectral pair encoding comprises at least one line spectral pair value that violates a value-ascendancy requirement.

19. The apparatus of claim 15 wherein the at least one of the plurality of encoded speech parameters comprises configuring the valid frame as a valid eighth rate frame, wherein the valid eighth rate frame is to be transmitted immediately following transmission of a full rate frame.

* * * * *